US005211045A

United States Patent [19]

Shimizu

[11] Patent Number: 5,211,045

[45] Date of Patent: May 18, 1993

[54] APPARATUS FOR DETERMINING CORRECT MOUNTING OF DIE ASSEMBLY ON PRESS BRAKE

[75] Inventor: Hidekazu Shimizu, Ishikawa, Japan

[73] Assignee: Kabushiki Kaisha Komatsu Seisakusho, Tokyo, Japan

[21] Appl. No.: 773,643

[22] PCT Filed: Feb. 25, 1991

[86] PCT No.: PCT/JP91/00242

§ 371 Date: Oct. 17, 1991

§ 102(e) Date: Oct. 17, 1991

[87] PCT Pub. No.: WO91/12908

PCT Pub. Date: Sep. 5, 1991

[30] Foreign Application Priority Data

Feb. 23, 1990 [JP] Japan ..... 2-16749[U]

[51] Int. Cl.[5] ..... B21D 1/22

[52] U.S. Cl. ..... 72/22; 72/21; 72/389; 72/461

[58] Field of Search ..... 72/2, 7, 21, 389, 461, 72/22

[56] References Cited

U.S. PATENT DOCUMENTS 4,831,862 5/1989 Ohashi et al. ..... 72/461

FOREIGN PATENT DOCUMENTS 0005823 1/1988 Japan ..... 72/461

01-57718 6/1989 Japan ..... 72/461

01-57719 6/1989 Japan ..... 72/461

*Primary Examiner*—David Jones

*Attorney, Agent, or Firm*—Varndell Legal Group

[57] ABSTRACT

An apparatus for determining correct mounting of a die assembly on a press brake is intended to determine whether the die assembly mounted on the press brake corresponds to the kind of work to be worked. Back-gauges are first located at predetermined positions and thereafter, they are displaced so that a distance from the center of a die to an end surface of the same is measured by distance sensors. Results are memorized as shape data on the die with respect to each of various kinds of works. When a die is selected corresponding to the kind of work to be worked prior to an operation of the press brake and the selected die is then mounted on the press brake, a distance from the center of the die to an end surface of the same is likewise measured corresponding to the position where the back-gauges are displaced in the upward/downward direction, and results from measuring operations are compared with the memorized shape data corresponding to the kind of work to be worked with respect to each position where the back-gauges are displaced in the upward/downward direction so as to determine whether the die mounted on the press brake corresponds to the kind of work to be worked. After the die assembly is correctly remounted on the press brake based on results derived from the foregoing determination, an interference region is properly settled based on the shape data.

7 Claims, 7 Drawing Sheets

FIG. 5

SHAPE DATA

| | Z-AXIS POSITION | X — d |
|---|---|---|
| WORK NO.1 | $Z_0$ | $X_0 - d_0$ |
| | $Z_1$ | $X_1 - d_1$ |
| | ⋮ | ⋮ |
| | $Z_n$ | $X_n - d_n$ |
| | ⋮ | ⋮ |
| | $Z_e$ | $X_e - d_e$ |
| WORK NO.2 | $Z_{02}$ | $X_{02} - d_{02}$ |
| | ⋮ | ⋮ |
| WORK NO.3 | ⋮ | ⋮ |

APPARATUS FOR DETERMINING CORRECT MOUNTING OF DIE ASSEMBLY ON PRESS BRAKE

TECHNICAL FIELD

The present invention relates generally to an apparatus for determining the correct mounting of a die assembly on a press brake. More particularly, the present invention relates to an apparatus of the foregoing type which assures that an occurrence of interference of back-gauges with the die assembly during an operation of the press brake can reliably be prevented by determining whether or not a correct die assembly corresponding to the kind of work to be worked is mounted on the press brake.

BACKGROUND ART

With respect to a press brake, a work has been hitherto bent by inserting it in the space between a punch and a die until it collides with back-gauges and then lowering the punch toward the die while the position where the work has been inserted in that way is restricted by the back-gauges.

Since a location where the work is to be bent by the press brake in cooperation of the punch with the die differs from step to step, there is a need of displacing the back-gauges at each step corresponding to the location where the work is to be bent. In addition, for the purpose of assuring operational safety during displacement of the back-gauges, there is a need of controllably displacing the back-gauges so as not to allow the back-gauges to interfere with a die assembly comprising a punch and die at all times. Indeed due to the fact that a die to be mounted on the press brake differs corresponding to the kind of work to be worked, and moreover, a region where the back-gauges interfere with die assembly differs corresponding to the kind of work to be worked, there is a need of controllably displacing the back-gauges corresponding to the kind of work to be worked.

Here, conventional typical techniques for avoiding undesirable interference of the back-gauges with the die assembly can be noted below.

1) An operator inputs into a controller (not shown) data indicative of the configuration of a die f, i.e., a lower die half of the die assembly by actuating a key board with his hands at every time when the die assembly is replaced with another one corresponding to the kind of work to be worked. As shown in FIG. 8, the foregoing data is essentially composed of a distance e from the center of the die f to an end surface of the same, a height h of the die f, a distance e from the center of a holder g for immovably holding the die f on a table (not shown) to an end surface of the same and a height h' of the holder g. On completion of the inputting operation, the controller calculates an interference region j as represented by hatched lines in the drawing based on the inputted data and then determines whether or not a target position at the foremost end of a back-gauge i enters the interference region i. Thereafter, the operator outputs results derived from the foregoing determination to the controller.
2) An operator likewise calculates the interference region j based on shape data on the die f with the aid of the controller at every time when the die f is replaced with another one. Thereafter, the operator inputs into the controller data indicative of the interference region j and then controllably displaces the back-gauge j so as not allow the foremost end of the back-gauge i to enter the interference region j.

According to the conventional techniques as mentioned above, however, since there is a need of inputting data into the controller at every time when the die f is replaced with another one, operations to be performed by an operator become complicated, and moreover, a burden to be borne by the operator is enlarged unavoidably.

Indeed, since a die replacing operation is an operation to be individually performed by the operator, there arises an occasion that a die is erroneously selected by the operator when the die replacing operation is performed. Similarly, since a data inputting operation is also an operation to be individually performed by the operator, it is anticipated that data on a die different from the die for which a die replacing operation has been practically performed are erroneously inputted into the controller. In addition, there is a possibility that a die is mounted at the position offset from its preset position toward the back-gauge side.

For this reason, there arises an occasion that an interference region is settled corresponding to a die different from the die practically mounted on the press brake. Otherwise, although the die practically mounted on the press brake is correct, there arises an occasion that the settled interference region does not correspond to the position where the die has been practically mounted on the press brake. In view of the foregoing circumstance, even when the back-gauges are controllably displaced so as not allow them to enter the interference region, there is still a possibility that a malfunction of interference of the back-gauges with the die is caused.

The present invention has been made in consideration of the aforementioned background and its object resides in providing an apparatus for determining correct mounting of a die assembly on a press brake wherein an occurrence of interference of back-gauges with the die assembly due to incorrect mounting of the die assembly on the press brake can reliably be prevented without any necessity for inputting shape data into a controller at every time when the die assembly comprising a die and a punch is replaced with another one, by determining whether or not the die assembly practically mounted on the press brake coincides with a correct die assembly corresponding to the kind of work to be worked.

DISCLOSURE OF THE INVENTION

The present invention provides an apparatus for determining the correct mounting of a die assembly on a press brake for bending a work wherein the work is inserted into the space defined between a punch and a die until it collides with back-gauges, and the punch is then displaced toward the die while the position where the work has been inserted in that way is restricted by the back-gauges, wherein the apparatus comprises;

distance sensors arranged at the foremost ends of the back-gauges to detect a distance between the back-gauges and the die, back-gauge displacing means for displacing the back-gauges in the direction of insertion of the work, and moreover, displacing the back-gauges in the upward/-downward direction, position detecting means for detecting the positions where the back-gauges have been displaced in the direction of insertion of the work, and moreover, detecting the positions where the back-gauges have been displaced in the upward/downward direction, first driving means for driving the back-gauge displacing means so as to allow the back-gauges to be displaced to predetermined positions as seen in the direction of insertion of the work as well as the back-gauges to be displaced in the upward/downward direction, calculating means for calculating a distance from the center of the die to an end surface of the same corresponding to the positions where the back-gauges have been displaced in the upward/downward direction, based on outputs from the distance sensors and an output from the position detecting means when the back-gauges are displaced by the first driving means, shape data memorizing means for memorizing as shape data on the die results derived from a calculation carried out by the calculating means with respect to each of dies corresponding to various kinds of works, second driving means for driving the back-gauge displacing means so as to allow the back-gauges to be displaced to predetermined positions as seen in the direction of insertion of the work as well as the back-gauges to be displaced in the upward/downward direction when a die is selected corresponding to the kind of work to be worked and the selected die is then mounted on the press brake, and determining means for determining whether or not the die mounted on the press brake is mounted corresponding to the kind of work to be worked, by calculating a distance from the center of the die to the end surface of the same corresponding to the positions where the back-gauges have been displaced in the upward/downward direction, based on outputs from the distance sensors and an output from the position detecting means when the back-gauges have been displaced by the second driving means, and then comparing results derived from the calculating operation with the shape data on the die memorized in the shape data memorizing means with respect to each position where the back-gauges are displaced in the upward/downward direction.

With such construction as described above, a distance 0 from the center of a die to an end surface of the same corresponding to the position where the back-gauges have been displaced in the upward/downward direction is measured, and results derived from measuring operations are memorized as shape data on the die with respect to each of various kinds of dies. Subsequently, when a die is selected corresponding to the kind of work to be worked and the selected die is then mounted on the press brake, a distance from the center of the die and an end surface of the same is likewise measured corresponding to the position where the back-gauges have been displaced in the upward/downward direction, and results derived from measuring operations are compared with the memorized shape data on the die corresponding to the kind of work to be worked with respect to each position where the back-gauges are displaced in the upward/downward direction, so as to determine whether or not the die mounted on the press brake corresponds to the kind of work to be worked. Then, when a correct die assembly is remounted on the press brake in consideration of results derived from the foregoing determination, an interference region is correctly settled based on the shape data on the die, whereby the press brake can be operated without an occurrence of interference of the back-gauges with the die assembly.

BRIEF DESCRIPTION OF THE DRAWINGS

FIG. 5 is a diagram which schematically illustrates the content of shape data for the apparatus in accordance with the embodiment of the present invention;

BEST MODE FOR CARRYING OUT THE INVENTION

Now, the present invention will be described in detail hereinafter with reference to the accompanying drawings which illustrate a preferred embodiment of the present invention.

Figure 2A:
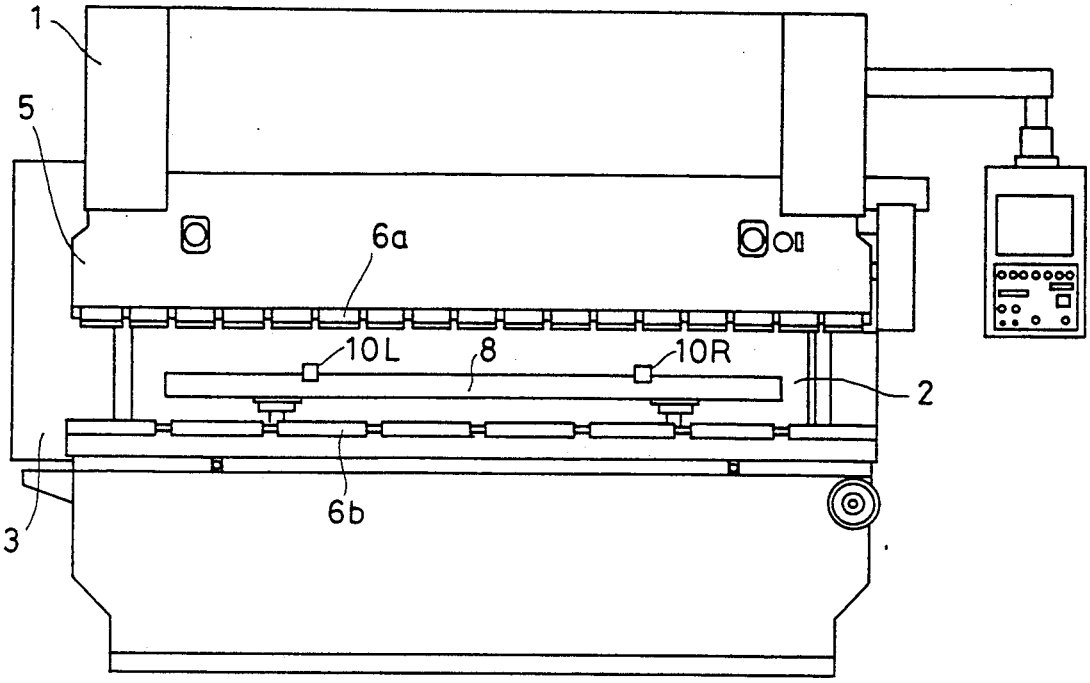
FIGS. 2(*a*) and (*b*) show a press brake to which the embodiment of the present invention is applied wherein FIG. 2(*a*) is a front view of the press brake and FIG. 2(*b*) is a side of the press brake in FIG. 2(*a*)
Figure 2B:
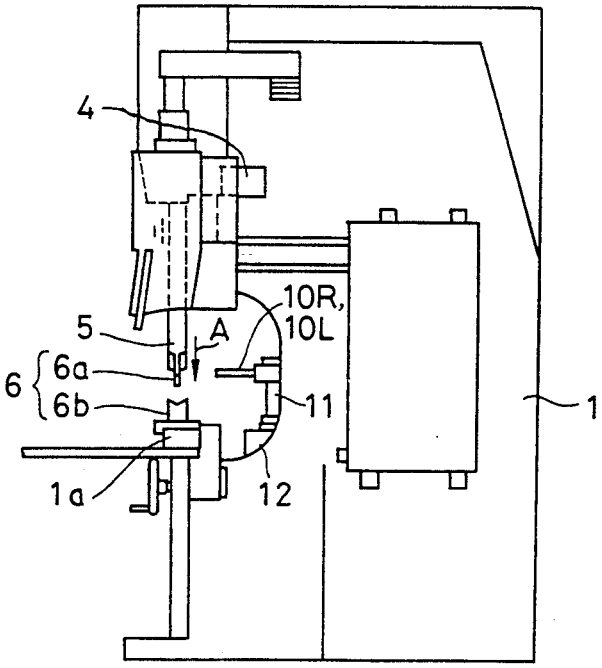

FIG. 2(*a*) is a front view of a press brake to which the embodiment of the present invention is applied, and FIG. 2(*b*) is a sectional view of the press brake shown in FIG. 2(*a*).

As shown in the drawings, the press brake is essentially composed of a press brake main body 1, a back-gauge displacing mechanism 2 to be described later and a numeral control unit 3 to be described later. The numerical control unit 3 serves to properly control driving operations of the back-gauge displacing mechanism 2.

The press brake main body 1 includes a beam 5 adapted to be displaced in the upward/downward direction by actuating a driving unit 4 including, e.g., a hydraulic driving power supply source. In addition, a punch 6*a* serving as an upper die half of a die assembly 6 is fixedly secured to the lower end of the beam 5, and a die 6*b* serving as a lower die half of the die assembly 6 is immovably mounted on the surface of a table 1*a*. A back-gauge 10R is fixedly mounted on a bar 8 extending in parallel with the beam 5 on the right-hand side of the press brake main body 1 as seen from the front side of the press brake, while another back-gauge 10L is likewise fixedly mounted on the bar 8 on the left-hand side of the same. When a work 7 (see FIG. 1(*a*)) is inserted in the space defined between the punch 6*a* and the die 6*b* from the front side of the press brake, both the back-gauges 10R and 10L restrictively determine the position where the work 7 is to be inserted therebetween.

With such construction, both the back-gauges 10R and 10L are displaced to reach a predetermined position corresponding to a location where the work 7 is to be bent, and the punch 6*a* is then lowered toward the die 6*b* from an upper dead point down to a lower dead point by actuating the driving unit 4, whereby the work 7 can be bent at a required position.

Figure 1A:
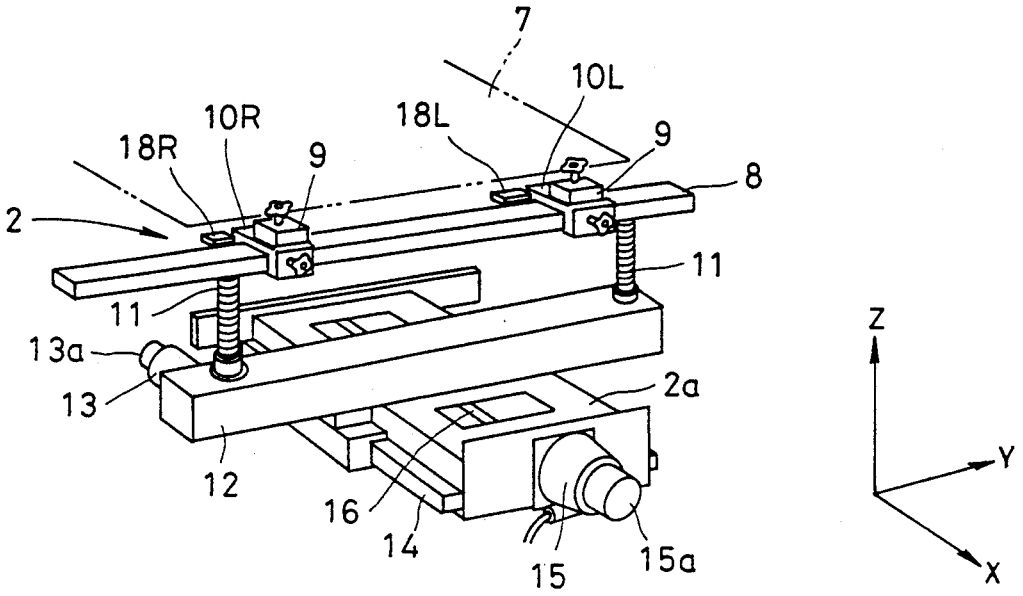
FIGS. 1(*a*) and 1(*b*) show an apparatus for determining correct mounting of a die assembly on a press brake in accordance with an embodiment of the present invention wherein FIG. 1(*a*) is a fragmentary perspective view of the apparatus, particularly illustrating a mechanism for displacing back-gauges and FIG. 1(*b*) is a block diagram of the apparatus, particularly illustrating the structure of a numerical control unit for controllably driving the mechanism shown in FIG. 1(*a*)
Figure 1B:
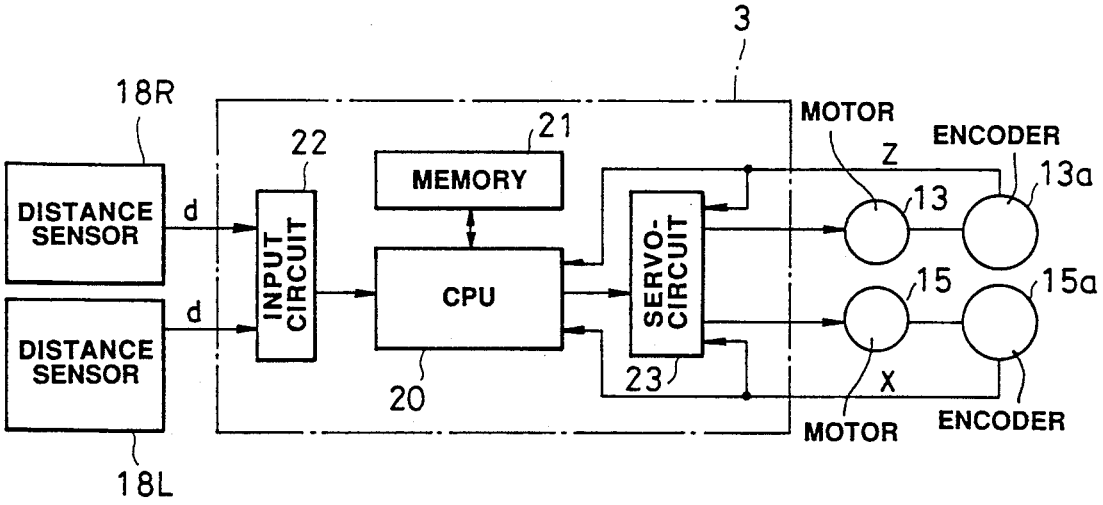

FIG. 1(*a*) shows by way of a perspective view the structure of the back-gauge displacing mechanism 2 which can displace the back-gauges 10R and 10L in two directions, i.e., a X-coordinate direction of insertion of the work 7 and a Z-coordinate direction (upward/-downward direction).

As shown in FIG. 1(*a*), the bar 8 is arranged to extend in the Y-coordinate direction at a right angle relative to the X-coordinate direction, and two slides 9 are slidably mounted on the bar 8 to slide in the Y-coordinate direction. Both the back-gauges 10R and 10L are mounted on the slides 9 so as to adjust their positions in the X-coordinate direction. The lower surface of the bar 8 is supported by a pair of male-threaded shafts 11 of which lower ends are threadably engaged with nut members (not shown) arranged in a slide base 12. The nut members are rotationally driven by actuating a servomotor 13. Thus, as the servomotor 13 is rotationally driven, the bar 8 is displaced in the upward/downward direction (Z-coordinate direction) via the nut members and the male-threaded shafts 11 so that the back-gauges 10R and 10L fixedly mounted on the bar 8 is displaced to an arbitrary position Z as seen in the upward/downward direction. Thereafter, both the back-gauges 10R and 10L are located at the foregoing positions. The servomotor 13 is equipped with an encoder 13*a* to detect the rotational position of the servomotor 13, i.e, the position Z of the back-gauges 10R and 10L as seen in the vertical/downward direction.

The slide base 12 is supported to slidably move along guide rails 14 extending in the X-coordinate direction on the opposite sides of a base platform 2*a*. In addition, the slide base 12 slidably moves along the guide rails 14 as a male-threaded shaft 16 is rotated. As a servomotor 15 is rotationally driven, the male-threaded shafts 16 are rotated. Thus, the slide base 12 can be displaced in the direction of insertion of the work 7 (X-coordinate direction) via the male-threaded shaft 16 by rotationally driving the servomotor 15, whereby the back-gauges 10R and 10L arranged in the integral relationship relative to the bar 8 can be displaced to the arbitrary position Z. The servomotor 15 is equipped with an encoder 15*a* to detect the rotational position of the servomotor 15, i.e. a position X of insertion of the work 7 relative to the back-gauges 10R and 10L.

The back-gauges 10R and 10L are equipped with distance sensors 18R and 18L at their foremost ends for contactlessly detecting a distance d between the back-gauges 10R and 10L and the die assembly 6 in such a manner as described later. For example, optical distance sensors each operable with a light beam as a detecting medium are preferably employable for the distance sensors 18R and 18L.

FIG. 1(*b*) is a block diagram which schematically illustrates the structure of the numerical control unit 3 for controlling driving operations of the back-gauge displacing mechanism 2 as constructed in the above-described manner. A detection signal indicative of the distance d between the right-hand distance sensor 18R and the left-hand distance sensor 18L, a detection signal indicative of the Z-coordinate position Z of the back-gauges 10R and 10L detected by the encoder 13*a* and a detection signal indicative of the X-coordinate position X of the back-gauges 10R and 10L detected by the encoders 13*a* and 15*a* are inputted into the numerical control unit 3. In addition, driving signals for driving the servomotors 13 and 15 are outputted from the numerical control unit 3.

The numerical control unit 3 is essentially composed of an input circuit 22 into which detection signals d derived from the distance sensors 18R and 18L are inputted to perform a processing operation such as analog/digital conversion or the like and from which detection signals d derived from the distance sensors 18R and 18L are inputted into a central processing unit (hereinafter referred to as a CPU) 20 to be described later, a memory 21 in which shape data on the die assembly to be described later are memorized and stored, the foregoing CPU 20 for perform processing operations to be described later in response to detection signals d outputted from the input circuit 22 and detection signals Z and X outputted from the encoders 13*a* and 15*a* so as to allow driving signals for driving the servomotors 13 and 15 to be outputted to a servo-circuit 23, and this servo-circuit 23 for performing a servo-controlling operation in response to the driving signals outputted from the CPU 20 in the form of a feedback quantity.

Here, a series of processing operations to be performed by the CPU 20 will be described below with reference to FIG. 3 to FIG. 7. It should be noted that description will be made below only with respect to the right-hand back-gauge 10R for the purpose of simplification of description.

PROCESSING OPERATION FOR REGISTERING SHAPE DATA

Figure 6:
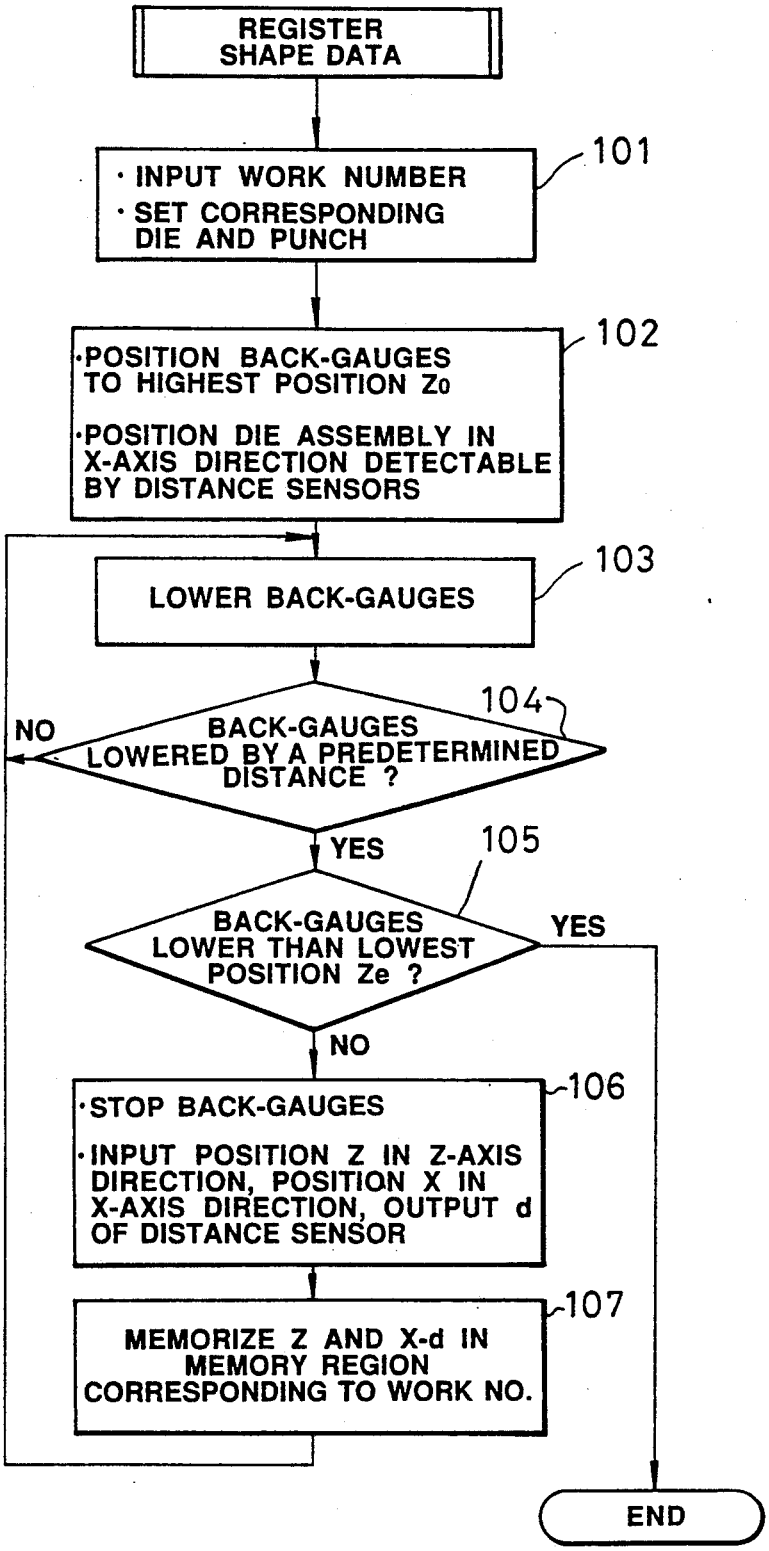
FIG. 6 is a flowchart which illustrates a procedure of a series of processing operations to be performed for registering shape data for the apparatus in accordance with the embodiment of the present invention.

This processing operation is previously performed before an operation of the press brake is started. A series of processing operations as shown in FIG. 6 are successively performed after an operator actuates a switch (not shown) on the numerical control unit 3 for selecting a "mode for teaching shape data on a die assembly".

To execute this teaching mode, a plurality of die assemblies 6 (each comprising a punch 6*a* and a die 6*b*) are prepared corresponding to all kinds of works 7 to be worked by the press brake.

When the kind "NO. 1" of work 7 is selected, a numeral "1" indicative of the foregoing kind of work 7 is inputted into the numerical control unit 3 via a key board. To receive data indicative of the shape of a die assembly 6 for bending the kind "NO. 1" of work 7, a die assembly 6 is prepared corresponding to the kind "NO. 1" of work 7, and it is immovably mounted on the press brake. Thereafter, the punch 6*a* is lowered in the A arrow-marked direction as seen in FIG. 2, whereby the operative state as shown in FIG. 3 is maintained (step 101).

When the operator instructs via the keyboard that an operation for mounting the die assembly on the press brake has been completed, the program goes to a next step 102. At the step 102, a driving signal is outputted to the motor 13 via the servo-circuit 23 in the numeral control unit 3 so as to allow the back-gauge 10R to be displaced to an uppermost position $Z_0$. As a result, the back-gauge 10R is located at the foregoing uppermost position $Z_0$. At the same time, another driving signal is outputted to the motor 15 via the servo-circuit 23 so as to allow the back-gauge 10R to be displaced to a predetermined position as seen in the X-coordinate direction where a distance d from the die assembly 6 can be detected by the distance sensor 18R. As a result, the back-gauge 10R is located at a position $X_0$. It should be noted that the X-coordinate axis extends from a reference position C as an original point and this reference position coincides with a reference position at which the center of the die assembly 6 is located when the die assembly 6 is mounted on the press brake. An operation for registering shape data on the die assembly 6 is performed on the assumption that the die assembly 6 is properly mounted such that the center of the die assembly 6 coincides with the reference position C and that the reference position C corresponds to the central position of the die assembly 6. At this time, a deviation $X_0-d_0$ of an output $X_0$ from the encoder 15*a* from an output $d_0$ from the distance sensor 18R is calculated by the CPU 20, and data $Z_0$:$X_0-d_0$ indicative of the shape of the die assembly 6 are memorized and stored in the memory region of the memory 21 corresponding to the kind "NO. 1" of work (see FIG. 5). The shape data $Z_0$:$X_0-d_0$ represent a distance as measured from the center C of the die assembly 6 (in practice, the beam 5) to one end thereof at a height $Z_0$, whereby the shape of the die assembly 6 can specifically be identified based on the foregoing distance (step 102).

Figure 3:
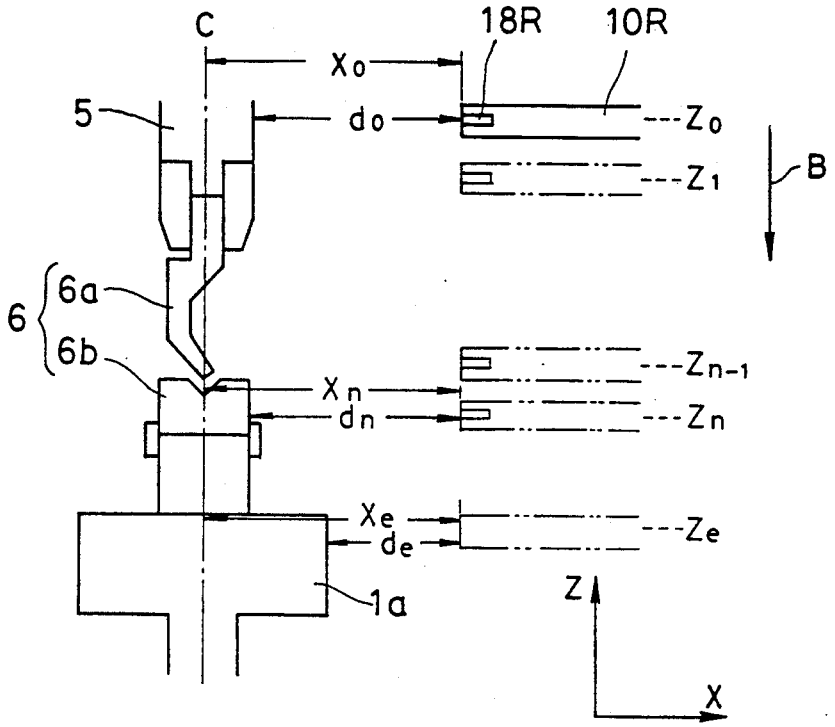
FIG. 3 is a fragmentary sectional view of the press brake, particularly illustrating a processing operation for registering shape data for the apparatus in accordance with the embodiment of the present invention.

Subsequently, a driving signal is outputted to the motor 13 via the servo-circuit 23 so as to allow the back-gauge 10R to be lowered from the uppermost position $Z_0$ in the B arrow-marked direction as seen in FIG. 3 (step 103), whereby the CPU 20 determines based on an output from the encoder 13*a* whether the back-gauge 10R is lowered by a predetermined distance or not (step 104). In addition, the CPU 20 determines whether the back-gauge 10R is lowered in excess of a lowest position $Z_e$ or not (step 105).

In a case where the CPU 20 determines that the back-gauge 10R has been lowered by the predetermined distance, and moreover, determines that the back-gauge 10R is located at the position higher than the lowest position $Z_e$, the numerical control unit 3 turns off the driving signal for the motor 13 and then displaces the back-gauge 10R from the position $Z_0$ down to another position spaced away therefrom by a predetermined distance (see FIG. 3). At this time, detection signals from the encoders 13*a* and 15*a* and a detection signal from the distance sensor 18R are inputted into the numerical control unit 3 in the same manner as mentioned above so that a deviation $X_1-d_1$ of an output $X_1$ of the encoder 15*a* from an output $d_1$ of the distance sensor 18R is calculated by the CPU 20 (step 106). Then, data $Z_1$:$X_1-d_1$ on the shape of the die assembly 6 are memorized and stored in the memory region of the memory 21 in the numerical control unit 3 corresponding to the kind "No. 1" of work (step 107).

Subsequently, when the CPU 20 determines at the step 105 in the same manner as mentioned above that the back-gauge 10R is located at the position higher than the lowest position $Z_e$, the numerical control unit 3 repeatedly performs a series of processing operations derived from the step 103 to the step 107. In other words, a number of shape data on the die assembly 6 obtained at every time when the back-gauge 10R is located at each of a number of positions $Z_2$—$Z_{n-1}$, $Z_n$—$Z_e$ as shown in FIG. 5 are memorized and stored in the memory 21, whereby an operation for registering shape data indicative of the kind "NO. 1" of work is completed.

It should be noted that a number of X-coordinate positions $X_0$ to $X_e$ may have a same distance measured from the reference position, respectively, and they may differ from each other depending on individual effective detection region of the distance sensor 18R. In addition, among the shape data, data indicative of a number of Z-coordinate positions $Z_0$ to $Z_{n-1}$ represent shape data on the punch 6*a* of the die assembly 7 inclusive of the beam 5, while data indicative of a number of Z-coordinate positions $Z_n-Z_e$ represent shape data on the die 6*b* of the die assembly 6 inclusive of the table 1*a*. It should be added that the region where shape data are obtained in the Z-coordinate direction may coincide with the region where shape data on the punch 6*a* and the die 6*b* are obtained in the Z-coordinate direction. In practice, it is not always required that the range where shape data are obtained in the Z-coordinate direction coincides with the range where shape data on the punch 6*a* and the die 6*b* are obtained in the Z-coordinate direction, but it suffices that the range where shape data are obtained in the Z-coordinate direction coincides with the range where the back-gauge 10R can be displaced in the Z-coordinate direction during an operation of the press brake.

The aforementioned operation for registering shape data on the die assembly 6 is repeatedly performed for other kinds of works, i.e., the kind "NO. 2" of work, the kind "NO. 3" of work—in the same manner as mentioned above so that the shape data corresponding to these kinds of works are memorized in such a manner as shown in FIG. 5. When shape data indicative of die assemblies 6 corresponding to all the kinds of works are obtained, it can be consumed that an operation for registering the shape data has been completed.

PROCESSING OPERATION FOR DETERMINING CORRECT MOUNTING OF A DIE ASSEMBLY ON THE PRESS BRAKE

When an operation for registering shape data indicative of the die assemblies 6 has been completed in the above-described manner, an operator prepares and then mounts a die assembly 6 corresponding to the kind of work to be worked, i.e., the kind of "NO. 1" on the press brake. Here, there is a possibility that the operator may erroneously select the die assembly 6, i.e., he may erroneously mount on the press brake a die assembly 6 which does not correspond to the kind "NO. 1" of work to be worked. For this reason, the numerical control unit 3 performs a processing operation for identifying the die assembly 6 so as to determine whether the die assembly 6 practically mounted on the press brake is a die assembly corresponding to the kind "NO. 1" of work or not.

Figure 7:
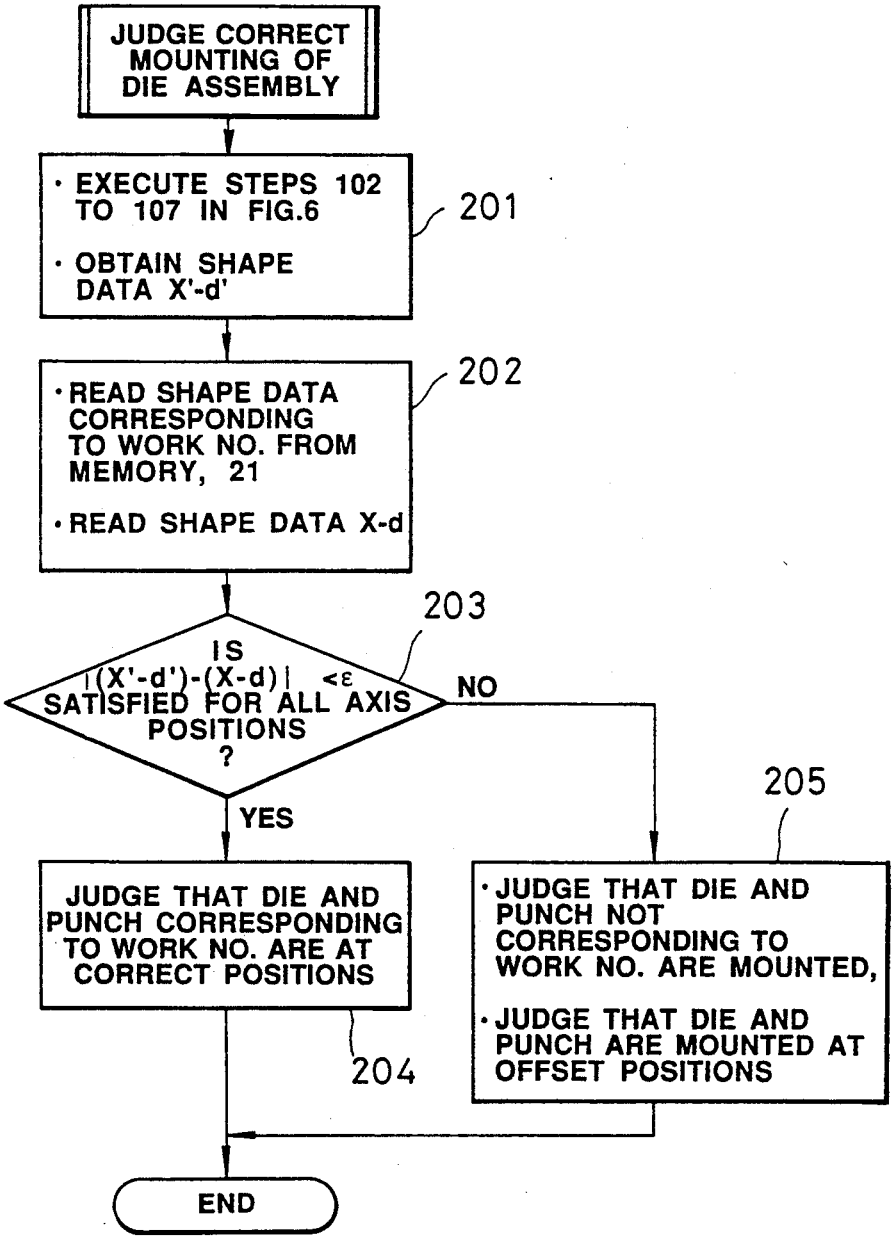
FIG. 7 is a flowchart which illustrates a procedure of a series of processings to be performed for determining correct mounting of a die assembly on a press brake with the aid of the apparatus in accordance with the embodiment of the present invention.
Figure 8:
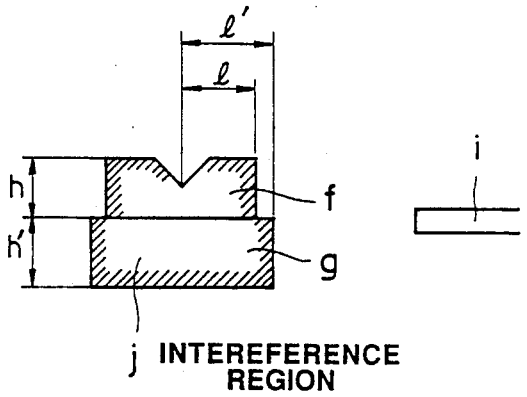
FIG. 8 is a fragmentary sectional view of a conventional die assembly to be mounted on a press brake, particularly illustrating the prior art.

Specifically, when the operator actuates a switch on the numerical control unit 3 for selecting "a mode for determining correct mounting a die assembly on the press brake", a series of processing operations as shown in FIG. 7 are started, and the numerical control unit 3 executes the steps 102 to 107 in the same manner as mentioned above. As a result, a number of shape data X'−d' (accompanying numerals 0, 1—removed therefrom) indicative of the die assembly 6 practically mounted on the press brake are obtained (step 201).

Subsequently, data indicative of the kind "NO. 1" of work to be worked are inputted into the numerical control unit 3. Thereafter, the CPU 20 reads the shape data X−d (accompanying numerals 0, 1—removed therefrom) which have been memorized in the memory 21 corresponding to the kind "NO. 1" of work(step 202).

Then, the CPU 20 determines based on the following inequality (1) whether or not an absolute value of deviation of the shape data X'−d' read at the step 201 from the shape data X−d read at the step 202 is smaller than a predetermined threshold $\epsilon$ at all the positions as seen in the Z−coordinate direction.

$$|(X'-d')-(X-d)|<\epsilon \quad (1)$$

Here, the above threshold $\epsilon$ represents a threshold required for allowing the CPU 20 to determine whether or not the die assembly 6 practically mounted on the press brake is a die assembly corresponding to the kind of work to be worked (step 203).

When it has been found at the step 203 that the inequality (1) is satisfied at all the positions $Z_0$, $Z_1$—as seen in the Z-coordinate direction, the CPU 20 determines that the die assembly 6 presently mounted on the press brake is a correct die assembly corresponding to the kind "NO. 1" of work, and moreover, determines that the center of the die assembly 6 is not positionally offset toward the back-gauge 10R side but the die assembly 6 has been correctly mounted on the press brake. Then, the numerical control unit 3 performs a displaying operation for representing that the die assembly 6 has been correctly mounted on the press brake. On completion of the displaying operation, the operator instructs that the press brake should start a working operation, i.e., a bending operation.

On the other hand, in a case where the CPU 20 determines that the above inequality (1) is not satisfied at all the position as seen in the Z-coordinate direction, the CPU 20 determines that the die assembly 6 presently mounted on the press brake does not correspond to the kind "NO. 1" of work or determines that the position where the die assembly 6 practically mounted on the press brake is undesirably offset from a predetermined position, although the die assembly 6 presently mounted on the press brake corresponds to the kind "NO. 1" of work.

For example, a reference for making a determination with the aid of the CPU 20 can be defined such that when a value indicative of the deviation (X'−d')−(X−d) fluctuates from position to position as seen in the Z-coordinate direction, the CPU 20 determines that the die assembly mounted on the press brake is an erroneous die assembly which does not correspond to the kind of work to be worked. Another reference for the same purpose may be defined such that when the CPU 20 confirms that the above deviation is uniform al all the positions as seen in the Z-coordinate direction, the CPU 20 determines that the die assembly 6 is mounted on the press brake at the position offset from the center thereof, although the die assembly 6 corresponds to the kind of work to be worked.

Since a number of deviations (X'−d')−(X−d)—at a plurality of positions $Z_0$ to $Z_{n-1}$ as seen in the Z-coordinate direction represent data on the punch 6a and a number of deviations (X'−d')−(X−d)—at a plurality of positions $Z_n$ to $Z_e$ as seen in the Z-coordinate direction represent data on the die 6b, this makes it possible to allow the CPU 20 to separately make a determination with respect to the punch 6a and the die 6b. In other words, with respect to the punch 6a and the die 6b, the CPU 20 can determine whether a correct kind of die assembly 6 is mounted on the press brake or not. Otherwise, the CPU 20 can determine that either of the punch 6a and the die 6b is mounted on the press brake while it is positionally offset from a predetermined position by a certain distance.

A result derived from the above determination is displayed on the numerical control unit 3. Thus, the operator can take an adequate measure based on the foregoing results for remounting another die assembly 6 corresponding to the kind "NO. 1" of work to be worked or correct the present position where the die assembly 6 is erroneously mounted on the press brake with undesirable positional deviation (step 205).

INTERFERENCE CHECK DURING AN OPERATION OF THE PRESS BRAKE

When the CPU 20 confirms that a correct die assembly 6 6 corresponding to the kind "NO. 1" of work to be worked is mounted on the press brake at a correct position, the numerical control unit 3 activates the press brake for bending the kind "NO. 1" of work 7. Here, the numerical control unit 3 performs a controlling operation for displacing the back-gauge 10R during every working stroke for the work 7, but there is a need of properly controlling the displacing mechanism 2 during displacement of the back-gauge 10R so as not to allow the foremost end of the back-gauge 10R to interfere with the die assembly 6. In view of the foregoing fact, according to the embodiment of the present invention, to prevent the foremost end of the back-gauge 10R from interfering with the die assembly 6 in the above-described manner, the CPU 20 detects a possibility that interference takes place during an operation of the press brake in such a manner as mentioned in the following paragraphs 1 and 2.

Figure 4:
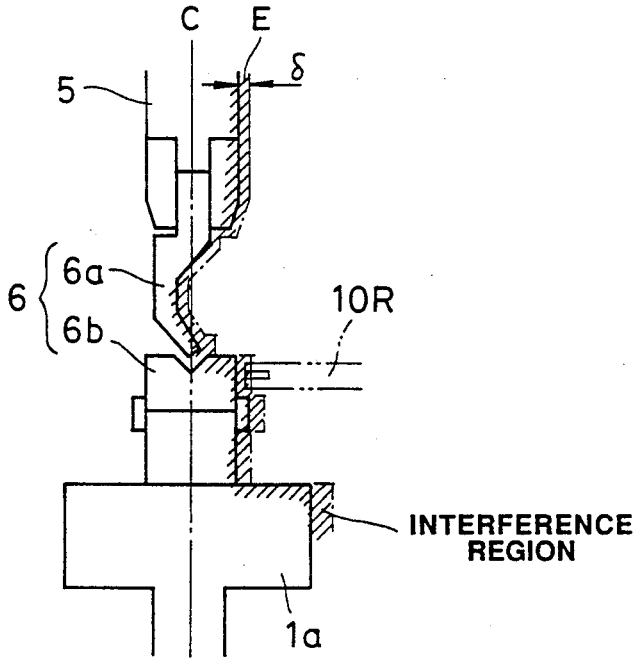
FIG. 4 is a fragmentary sectional view of the press brake, particularly illustrating a processing operation of interference check for the apparatus in accordance with the embodiment of the present invention.

1) As shown in FIG. 4, a line E spaced away from the end surface on the back-gauge 10R side of the die assembly 6 (inclusive of the beam 5 and the table 1a) in the direction toward the back-gauge 10R by a predetermined distance is settled such that the region extending from the line E toward the die assembly 6 is identified as an interference region. Specifically, the interference region can be defined as a region which remains within the range where a X-coordinate position x is determined based on a plurality of shape data X−d—memorized in the memory 21 corresponding to the kind "NO. 1" of work in accordance with the following inequality.

$$x<X-d+\delta \quad (2)$$

As the back-gauge 10R is controllably displaced depending on each step to be executed for the work 7, the CPU 20 reads the shape data X−d corresponding to an output Z from the encoder 13a and then determines whether the shape data X−d and the output x from the encoder 15a satisfy the relationship defined by the above inequality (2) or not. In a case where the CPU 20 determines that the relationship defined by the inequality (2) has been satisfied, this means that there is a possibility that the back-gauge 10R interferes with the die assembly 6 (see FIG. 4). For this reason, the numerical control unit 3 performs a controlling operation in such a manner as to avoid an occurrence of interference by settling a passage extending in the rightward direction as seen in the drawing so as to allow the back-gauge 10R to be parted away from the interference region.

2) The CPU 20 normally determines during an operation of the press brake whether or not an output d from the distance sensor 18R remains within the range defined by the following inequality at all times.

$$d<\delta \quad (3)$$

Since the back-gauge 10R remains within the interference range as shown in FIG. 4 as long as the above inequality (3) is satisfied, the numerical control unit 3 performs a controlling operation in such a manner as to avoid an occurrence of interference by settling a passage extending in the rightward direction as seen in the drawing so as to allow the back-gauge 10R to be parted away from the interference region. In addition, when it has been found that the above inequality (3) is satisfied, the numerical control unit 3 may perform a controlling operation in such a manner as to turn off driving signals for the motors 13 and 15 thereby to immediately stop actuation of the back-gauge 10R. Alternatively, when it has been found that the above inequality (3) is satisfied, the numerical control unit 3 may perform a controlling operation in such a manner as to generate an alarm which informs an operator of an information representing that the back-gauge 10R remains within the interference region.

When interference check is carried out in the above-described manner, the CPU 20 confirms a processing operation for identifying the die assembly 6 to confirm that the die assembly 6 mounted on the press brake correctly corresponds to the kind of work to be worked. Thus, the apparatus of the present invention assures avoidance of an occurrence of malfunction which has arisen with a press brake of the prior art. Specifically, this malfunction is caused such that when an interference region is settled using shape data corresponding to the kind of a work to be worked, there appears a problem that another interference region is settled or set corresponding to a die assembly different from the die assembly practically mounted on the press brake. In addition, since the CUP 20 confirms with a processing operation for identifying the die assembly 6 that the die assembly 6 practically mounted on the press brake is mounted at a predetermined correct position, the apparatus of the present invention assures avoidance of an occurrence of another malfunction which has arisen with the press brake of the prior art. Specifically, this malfunction is caused such that the interference region settled based on the shape data does not undesirably coincide with the interference region corresponding to the position where the die assembly 6 is practically mounted on the press brake. Consequently, the interference region which has been settled in the above-described manner can be used as an interference region having high reliability. Thus, the apparatus of the present invention assures reliable avoidance of an occurrence of interference by controllably displacing the back-gauge 10R so as not allow it to enter the interference region.

The present invention has been described above with respect to the embodiment wherein only the back-gauge 10R is taken in consideration for the purpose of simplification of description. Also with respect to the back-gauge 10L, a processing operation for registering shape data is performed in the same manner as that of the back-gauge 10R with the aid of the distance sensor 18L. In some case, the present invention may be carried out by performing a processing operation for registering shape data with the aid of a distance sensor associated with one back-gauge but neglecting such a processing operation as mentioned above with respect to other back-gauge.

According to the aforementioned embodiment of the present invention, shape data are obtained with respect to the die assembly 6 comprising a punch **6*a* and a die 6*b*. Alternatively, in a case where the kind of punch 6*a* is unchangeably predetermined and there is no need of replacing the punch 6*a* with another one, shape data may be obtained only with respect to the die 6*b*. In addition, shape data may be obtained only with respect to the punch 6*a***.

The present invention has been described above with respect to the embodiment wherein it has been applied to a press brake of the type including a punch **6*a* adapted to be lowered toward a die 6*b*. The present invention should not only to this embodiment but it may equally be applied to a press brake of the type including a die 6*b* to be elevated toward a die 6*a***.

INDUSTRIAL APPLICABILITY

As is apparent from the above description, according to the present invention, there is no need of performing any complicated operation for inputting data into the CPU for the purpose of settling an interference region at every time when a die assembly including a die is replaced with another one. Indeed, the CPU can exactly determine whether or not the die assembly practically mounted on the press brake coincides with a correct die assembly corresponding to the kind of work to be worked. In addition, the CPU can determine whether or not the die assembly is mounted at a predetermined correct position. This assures that an occurrence of interference of the back-gauges with the die assembly due to incorrect mounting of the die assembly on the press brake can be prevented reliably. Conclusively, operational safety of the press brake can amazingly be improved by applying the present invention to the press brake.

I claim:

1. An apparatus for determining a correct mounting of a die on a press brake for bending a work selected from among different works, said die being selected from among a plurality of dies respectively corresponding to said different works, said selected work being inserted into a space defined between a punch and said selected die until said selected die work collides with back-gauges, said punch being displaced toward said selected die to bend said selected work when said selected work reaches an insertion position restricted by said back-gauges, said apparatus comprising:

distance sensors means provided on work-collision surfaces of said back-gauges for detecting a distance between said work-collision surfaces and a side surface of said die facing said work-collision surfaces;

back-gauge displacing means for displacing said back-gauges toward and away from said die in a horizontal direction along a horizontal axis X and in upward and downward directions along a vertical axis Z;

position detecting means for detecting positions on said back-gauges on said horizontal axis X from a mounting reference point C of said die on said press brake when said back-gauges are displaced along said horizontal axis X and for detecting positions of said back-gauges on said vertical axis Z when said back-gauges are displaced along said vertical axis Z;

driving means, operating when said die is mounted on said brake, for driving said back-gauge displacing means for displacing said back-gauges to predetermined locations on said horizontal axis X and for displacing said back-gauges in said upward and downward directions along said vertical axis Z within a range from an uppermost position of said die to a lowermost position of said die;

calculating means for calculating, based an outputs from said distance sensors means and outputs from said position detecting means, respective distances from said mounting reference point C on said press brake to said die surface of said die at predetermined positions on said vertical axis Z, prior to carrying out said bending of said selected work by said press brake and while said back-gauges are being displaced in said upward and downward directions by said driving means, said calculating being carried out for all of said plurality of dies which are sequentially mounted on said press brake in such a manner that a center of each die coincides with said mounting reference point C on said press brake;

distance data memorizing means for memorizing respective distances from said mounting reference position C to said side surface of said die calculated by said calculating means at said predetermined positions on said vertical axis Z for each of said different works;

determining means, operating when said selected die is mounted on said press brake, for calculating distances from said mounting reference position C to a side surface of said selected die at said predetermined positions on said vertical axis Z based on outputs from said distance sensors means and said position detecting means while said back-gauges are displaced in said upward and downward directions by said driving means, for calculating deviations between calculated distances for said selected die and said respective distances memorized in said distance data memorizing means corresponding to said selected work, and for determining whether said mounted die is correct for said selected work based on whether a variance of said deviations is less than a predetermined value.

2. An apparatus for determining a correct mounting of a punch on a press brake for bending a work selected from among different works, said punch being selected from among a plurality of punches respectively corresponding to said different works, said selected work being inserted into a space defined between said punch and a die until said selected work collides with back-gauges, said selected punch being displaced toward said die to bend said selected work when said selected work reaches an insertion position restricted by said back-gauges, said apparatus comprising:

distance sensors means provided on work-collision surfaces of said back-gauges for detecting a distance between said work-collision surfaces and a side surface of said punch facing said work-collision surfaces;

back-gauge displacing means for displacing said back-gauges toward and away from said punch in a horizontal direction along a horizontal axis X and in upward and downward directions along a vertical axis Z;

position detecting means for detecting positions on said back-gauges on said horizontal axis X from a mounting reference point C of said punch on said press brake when said back-gauges are displaced along said horizontal axis X and for detecting positions of said back-gauges on said vertical axis Z when said back-gauges are displaced along said vertical axis Z;

driving means, operating when said die is mounted on said brake, for driving said back-gauge displacing means for displacing said back-gauges to predetermined locations on said horizontal axis X and for displacing said back-gauges in said upward and downward directions along said vertical axis Z within a range from an uppermost position of said punch to a lowermost position of said punch;

calculating means for calculating, based an outputs from said distance sensors means and outputs from said position detecting means, respective distances from said mounting reference point C on said press brake to said side surface of said punch at predetermined positions on said vertical axis Z, prior to carrying out said bending of said selected work by said press brake and while said back-gauges are being displaced in said upward and downward directions by said driving means, said calculating being carried out for all of said plurality of punches which are sequentially mounted on said press brake in such a manner that a center of each punch coincides with said mounting reference point C on said press brake;

distance data memorizing means for memorizing respective distances from said mounting reference position C to said side surface of said punch calculated by said calculating means at said predetermined positions on said vertical axis Z for each of said different works;

determining means, operating when said selected punch is mounted on said press brake, for calculating distances from said mounting reference position C to a side surface of said selected punch at said predetermined positions on said vertical axis Z based on outputs from said distance sensors means and said position detecting means while said back-gauges are displaced in said upward and downward directions by said driving means, for calculating deviations between calculated distances for said selected punch and said respective distances memorized in said distance data memorizing means corresponding to said selected work, and for determining whether said mounted punch is correct for said selected work based on whether a variance of said deviations is less than a predetermined value.

3. An apparatus for determining a correct mounting of a die and a punch on a press brake for bending a work selected from among different works, said die and said punch being selected from along a plurality of dies and a plurality of punches respectively corresponding to said different works, said selected work being inserted into a space defined between said selected punch and said selected die until said selected work collides with back-gauges, said selected punch being displaced toward said selected die to bend said selected work when said selected work reaches an insertion position restricted by said back-gauges, said apparatus comprising:

distance sensors means provided on work-collision surfaces of said back-gauges for detecting a distance between said work-collision surfaces and a side surface of said die and said punch facing said work-collision surfaces;

back-gauge displacing means for displacing said back-gauges toward and away from said die and said punch in a horizontal direction along a horizontal axis X and in upward and downward directions along a vertical axis Z;

position detecting means for detecting positions on said back-gauges on said horizontal axis X from a mounting reference point C of said die and said punch on said press brake when said back-gauges are displaced along said horizontal axis X and for detecting positions of said back-gauges on said vertical axis Z when said back-gauges are displaced along said vertical axis Z;

driving means, operating when said die is mounted on said brake, for driving said back-gauge displacing means for displacing said back-gauges to predetermined locations on said horizontal axis X and for displacing said back-gauges in said upward and downward directions along said vertical axis Z within a range from an uppermost position of said die and said punch to a lowermost position of said die and said punch;

calculating means for calculating, based an outputs from said distance sensors means and outputs from said position detecting means, respective distances from said mounting reference point C on said press brake to said side surfaces of said die and said punch at predetermined positions on said vertical axis Z, prior to carrying out said bending of said selected work by said press brake and while said back-gauges are being displaced in said upward and downward directions by said driving means, said calculating being carried out for all of said plurality of dies and said plurality of punches which are sequentially mounted on said press brake in such a manner that a center of each die and a center of each punch coincide with said mounting reference point C on said press brake;

distance data memorizing means for memorizing respective distances from said mounting reference position C to said side surface of said die and said punch calculated by said calculating means at said predetermined positions on said vertical axis Z for each of said different works;

determining means, operating when said selected die and said selected punch are mounted on said press brake, for calculating distances from said mounting reference position C to side surfaces of said selected die and said selected punch at said predetermined positions on said vertical axis Z based on outputs from said distance sensors means and said position detecting means, while said back-gauges are displaced in said upward and downward directions by said driving means, for calculating deviations between calculated distances for said selected die and selected punch and said respective distances memorized in said distance data memorizing means corresponding to said selected work, and for determining whether said mounted die and punch are correct for said selected work based on whether a variance of said deviations is less than a predetermined value.

4. An apparatus as claimed in claim 3, including means for setting an interference region where said back-gauges interfere with said die and said punch based on said distances memorized in said distance data memorizing means and for controlling said back-gauges displacing means in response to outputs from said distance sensors means during operation of said press brake so that said back-gauges do not enter into said interference region.

5. An apparatus as claimed in claim 3, including means for setting an interference region where said back-gauges interfere with said die and said punch based on said distances memorized in said distance data memorizing means and for detecting when said back-gauges enter into said interference region based on outputs from said distance sensors means during operation of said press brake and stopping said back-gauges.

6. An apparatus as claimed in claim 3, including means for setting an interference region where said back-gauges interfere with said die and said punch based on said distances memorized in said distance data memorizing means and for detecting when said back-gauges enter into said interference region based on outputs from said distance sensors means during operation of said press brake and issuing an alarm.

7. An apparatus as claimed in claim 3, wherein said determining means includes means for determining that said selected die and said selected punch are correct for said selected work but are mounted with positional offset in said horizontal direction, when said variance of said deviations is less than said predetermined value and when deviations based on said predetermined positions on said vertical axis Z exceed a predetermined threshold value.

* * * * *